US008100166B2

(12) United States Patent
Bausch et al.

(10) Patent No.: US 8,100,166 B2
(45) Date of Patent: Jan. 24, 2012

(54) CONTINUOUS CASTING PLANT AND METHOD OF OPERATING A CONTINUOUS CASTING PLANT

(75) Inventors: Jörg Bausch, Düsseldorf (DE); Bernd Leifeld, Meerbusch (DE); Jürgen Müller, Kaarst (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 128 days.

(21) Appl. No.: 12/224,700

(22) PCT Filed: Mar. 8, 2007

(86) PCT No.: PCT/EP2007/002005

§ 371 (c)(1),
(2), (4) Date: Sep. 3, 2008

(87) PCT Pub. No.: WO2007/101685

PCT Pub. Date: Sep. 13, 2007

(65) Prior Publication Data

US 2009/0020259 A1 Jan. 22, 2009

(30) Foreign Application Priority Data

| | | |
|---|---|---|
| Mar. 9, 2006 | (DE) | 10 2006 011 385 |
| Nov. 10, 2006 | (DE) | 10 2006 053 016 |
| Nov. 24, 2006 | (DE) | 10 2006 055 443 |
| Feb. 6, 2007 | (DE) | 10 2007 005 778 |

(51) Int. Cl.
*B22D 11/12* (2006.01)
*B22D 11/128* (2006.01)

(52) U.S. Cl. ..... 164/484; 164/442; 164/448

(58) Field of Classification Search ..... 164/484, 164/441, 442, 447, 448
See application file for complete search history.

(56) References Cited

U.S. PATENT DOCUMENTS

| | | | | |
|---|---|---|---|---|
| 5,400,850 | A | 3/1995 | Glemming et al. | |
| 6,427,758 | B1 * | 8/2002 | Klassen | 164/454 |
| 2004/0045695 | A1 * | 3/2004 | Rittner et al. | 164/442 |
| 2005/0167076 | A1 * | 8/2005 | Hennig et al. | 164/476 |

FOREIGN PATENT DOCUMENTS

| | | |
|---|---|---|
| DE | 196 37 545 | 3/1998 |
| EP | 0 074 247 | 3/1983 |
| EP | 0 083 917 | 7/1983 |
| GB | 1 222 337 | 2/1971 |
| GB | 1 463 523 | 2/1977 |
| WO | 01/87518 | 11/2001 |

* cited by examiner

*Primary Examiner* — Kevin P Kerns
(74) *Attorney, Agent, or Firm* — Lucas & Mercanti, LLP; Klaus P. Stoffel

(57) ABSTRACT

A continuous casting installation, which has a vertically oriented strand guide arranged below a mold, wherein a drive for driving the cast strand and bending it into the horizontal direction are arranged below the strand guide. A drive that serves exclusively for driving the cast strand is installed below the lower end of the strand guide, and a drive that serves exclusively for bending the cast strand is installed below the drive for driving the cast strand. The drive that serves exclusively for driving the cast strand is installed at least partially in a cassette, which is detachably mounted in the continuous casting installation. The continuous casting installation also has a cooling chamber, and the cassette with the drive that serves exclusively for driving the cast strand is installed in the cooling chamber.

12 Claims, 6 Drawing Sheets

CONTINUOUS CASTING PLANT AND METHOD OF OPERATING A CONTINUOUS CASTING PLANT

BACKGROUND OF THE INVENTION

The invention concerns a continuous casting installation, especially for the continuous casting of thin slabs, which has a vertically oriented strand guide arranged below a mold and in which means for driving the cast strand and bending it into the horizontal direction are arranged below the strand guide. The invention also concerns a method for operating a continuous casting installation.

Continuous casting installations of this type are sufficiently well known in the prior art.

The starting point for continuous casting installations of this type are curved mold continuous casting machines or vertical bending installations with a casting radius of generally seven to twelve meters for relatively large casting thicknesses, at which the strand with a liquid core is bent and straightened.

The term "CSP" (Compact Strip Production) denotes a continuous casting process for thin slabs, which usually have a thickness of 45-70 mm and occasionally up to 90 mm. In this case, the vertical type of installation construction is widely used, in which the cast strand is not bent and straightened until after it has thoroughly solidified. An advantage of CSP plants is that the design of the plant can be kept simple, especially where the strand guide is concerned. For example, in the event of a strand breakout below the mold, the mold and the affected members of the strand guide can be removed and replaced from above with a crane. In this type of plant, much less work is required for making the change and thus the associated loss of production is smaller than when standard curved segments are used, which cannot be removed from above.

Another advantage is that the strand is not bent and straightened until it has completely solidified. Therefore, the strand expansions are smaller; there is no need to fear that the sensitive inner side of the strand will be torn up.

FIG. 1 shows a prior-art continuous casting installation 1 of this type. Cast steel moves vertically downward from a mold 2, and the strand 6 produced in this way is guided along a strand guide 3. By the time the strand 6 leaves the lower end of the strand guide 3, it is essentially completely solidified. Below the strand guide 3, the strand 6 enters an area that is equipped with means 4, 5 for the combined driving and bending of the strand 6. As the drawing shows, in the direction of its conveyance, the strand 6 first passes through two bending drivers, which both drive the strand 6 in the direction of conveyance and act on it with bending forces. The rolls of the bending driver 4, 5 are set by a displacement device 11. The following rolls bend the strand further towards the horizontal H. Finally, the strand 6 leaves the installation in the horizontal direction H and is conveyed further to suitable downstream installations. The cooling chamber 12 for cooling the strand 6 is only schematically illustrated.

In accordance with the above explanations, it is desirable that the available height of the strand guide should be as great as possible and, for a given installation height, the height at which the bending of the strand occurs should be as low as possible, for in this way the maximum path is available for the complete solidification of the strand along the strand guide.

Therefore, the objective of the present invention is to further develop a continuous casting installation of the type described at the beginning and to develop a suitable method for operating a continuous casting plant in such a way that it is possible to use the greatest possible height of the strand guide at the lowest possible height for the driving, bending, and straightening of the cast strand. The region of the driving and bending is thus to be shortened in favor of a lengthened strand guide. A further objective of the present invention is to create the favorable possibility of being able to eliminate disruptions and carry out repair and maintenance work as quickly and efficiently as possible. The lengthening of the strand guide is intended to increase the productivity of the plant.

SUMMARY OF THE INVENTION

In accordance with the invention, the objective with respect to the installation is characterized by the fact that means that serve exclusively for driving the cast strand are installed below the lower end of the strand guide of the continuous casting installation, and means that serve exclusively for bending the cast strand are installed below the means for driving the cast strand.

In accordance with the invention, therefore, the previously known combined means for driving the cast strand, on the one hand, and for bending the cast strand, on the other, i.e., the "bending driver", are divided into separate elements. As will be seen in the discussion that follows, this not only provides specific advantages but also achieves the objective stated above.

Preferably, it is provided that the means that serve exclusively for driving the cast strand have at least one pair of rolls, which consist of several roll segments, which are arranged in succession in the direction transverse to the direction of conveyance of the strand and are supported by central bearings. This offers the advantage that it is possible to use rolls with diameters smaller than previously customary. This reduces the overall height required for the driver.

The means that serve exclusively for driving the cast strand preferably comprise only a single pair of driven rolls. The use of only a single pair of rolls was found to be adequate and saves height for the driver in favor of a longer strand guide.

In addition, it can be provided that the means that serve exclusively for driving the cast strand are mounted, preferably detachably (e.g., by a bolted connection), on a segmented frame located above these means. This design makes it possible to stiffen the strand guide. In addition, this allows simplified changing of the means.

In accordance with a very advantageous modification, the means that serve exclusively for driving the cast strand are housed at least partially in a cassette, which is detachably installed in the continuous casting installation. The one or more pairs of rolls are preferably completely housed in the cassette.

In this connection, it can be provided that at least one roll of the pair of rolls or the pair of rolls as a whole can be moved by a displacement device in the direction normal to the surface of the strand. It is also possible for only one of the rolls to be movable by the displacement device, e.g., the roll on the fixed side can be moved by hydraulic cylinder.

The specified movement can be necessary to position the driver exactly below the strand guide in alignment with the cast strand. However, it may also be necessary under certain circumstances to use this displacement device to press the rolls against the surface of the strand.

The rolls of the means that serve exclusively for driving the strand can in any case be acted upon by force in the direction normal to the surface of the strand by possibly separate force generation elements. The contact force necessary for transmitting conveying motion to the strand is generated in this way. In this regard, the force generation elements can be supported on the framework of the continuous casting installation or on a structural member that is rigidly joined with the framework. However, it is also possible for the force generation elements to be supported on the cassette.

The cylinders for pressing the drive rolls against the strand can thus be installed alternatively in the cassette or on the foundation, especially in the cooling chamber of the continuous casting installation. To allow changing of the cassette, the cylinders can be flanged on the cassette. This results in the advantage that without cylinders, the driver cassette fits through the narrow 4-excenter oscillation frame that is usually used, and this facilitates mounting and dismounting.

It is preferably provided that the continuous casting installation also has a cooling chamber, as is customary, and that the means that serve exclusively for driving the cast strand are installed in the cooling chamber. In this regard, it can be provided especially that the bottom of the cooling chamber runs below the means that serve exclusively for driving the cast strand and above the means that serve exclusively for bending the cast strand.

The method for operating a continuous casting installation of this type, especially for the production of thin slabs, is characterized by the fact that the cast strand is initially guided vertically downward through the strand guide. Below the lower end of the strand guide, the strand is conveyed downward by means that serve exclusively for driving it and is then deflected from the vertical to the horizontal by means that serve exclusively for bending it.

In this connection, it is preferably provided that there is no conveyance of the strand in the bending zone, in which it is deflected from the vertical to the horizontal. Conveyance should not be provided again until the strand has been largely deflected into the horizontal direction.

In the region below the strand guide until the discharge of the strand in the horizontal direction, the strand is preferably cooled only in the region of the means that serve exclusively for driving the cast strand.

Various advantages are obtained with the proposed installation and the proposed method.

The two or four rolls of the bending driver that are customarily used in the prior art are separated into the specified means that serve exclusively for driving and exclusively for bending. This means that savings can be realized with respect to the overall height of the installation, as will be explained below. Therefore, the means for driving serve only for driving the hot strand and dummy bar. The means for bending now carry out only the functions of bending the strand, separating the hot strand from the dummy bar, driving the dummy bar, and supporting the hot strand.

In the region of the strand guide, the strand is not conveyed by driven rolls. It is conveyed solely by the means that serve exclusively for driving the cast strand.

By housing the means that serve exclusively for driving the cast strand in a cassette and installing the cassette in the cooling chamber, the driver cassette can be changed like a segment of the strand guide, i.e., in the upward direction through the opening of the oscillating frame. This can be accomplished more simply and quickly than horizontal changing of the individual drive rolls, as has been done until now.

Overall height is also saved by using rolls with a smaller diameter in the driver. This can be realized by using several successively arranged segmented rolls with central bearings.

Another very advantageous feature of the solution proposed by the invention is that the bending roll does not always have to be changed together with the drive roll. This is an advantage, because the drive rolls are subject to greater wear. The proposed solution of the invention makes it possible, rather, to change the rolls separately as needed, i.e., to change the rolls of the driver (especially by vertical changing of the cassette) and the rolls of the bender (especially by horizontal changing of the bending rolls). In addition, the driver cassette can be changed as needed, independently of the strand guide segments arranged above it.

In the proposed solution, the drive rolls are thus located upstream of the strand arc. The additional space for the strand guide is obtained by the reduction of the diameter of the preferably multiply segmented rolls and reduction of the separation between them and especially by the installation of the drive rolls in the cooling chamber.

This makes it possible not to bend and straighten the strand until complete solidification has occurred, which increases the inner quality of the strand.

The bending forces are absorbed by the drive rolls and do not enter the strand guide.

The bending segments can be removed the same way as the strand guide segments, i.e., towards the top.

BRIEF DESCRIPTION OF THE DRAWING

The drawings show both prior-art embodiments and embodiments in accordance with the invention.

DETAILED DESCRIPTION OF THE INVENTION

Figure 1:
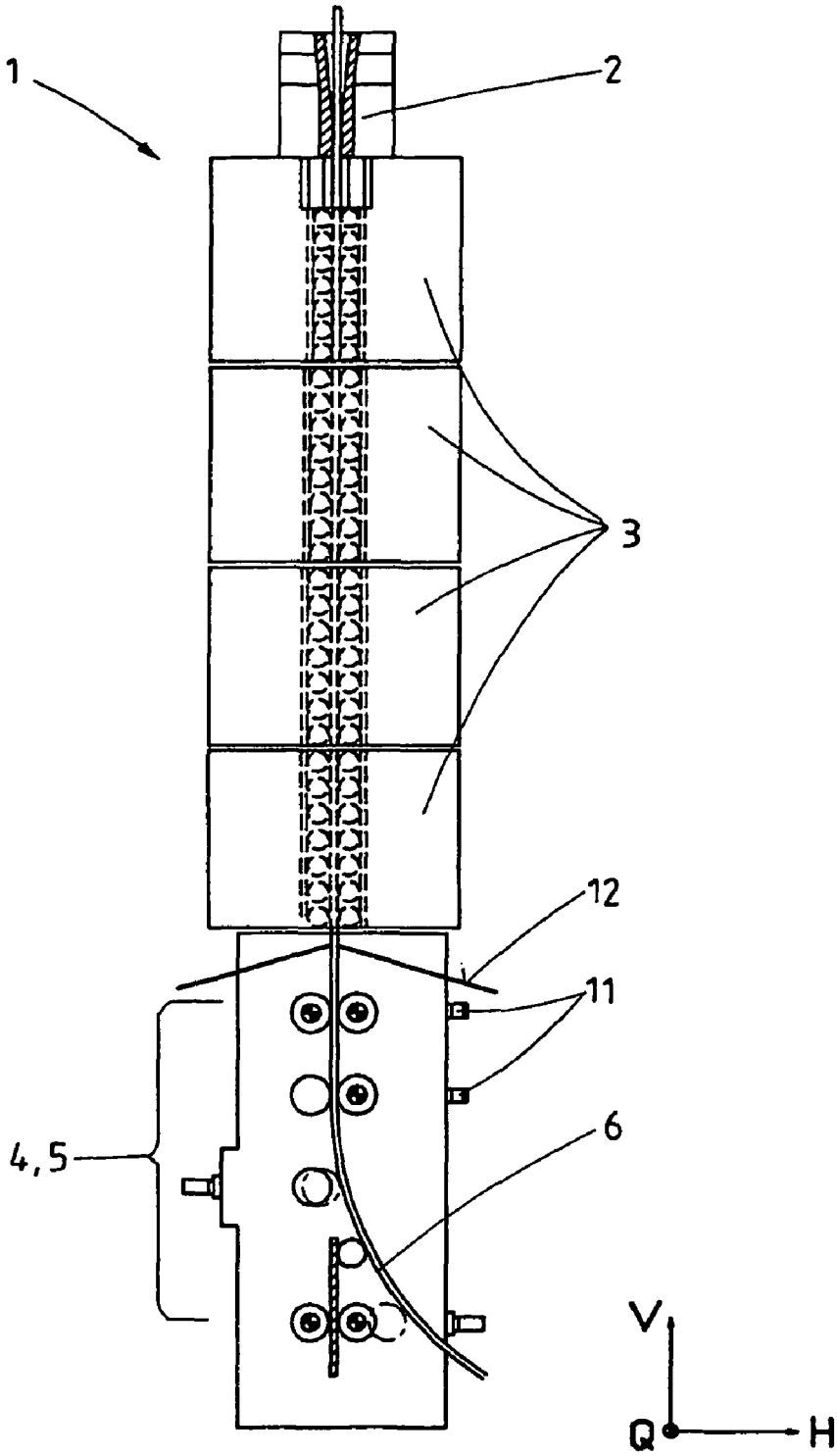
FIG.1 PRIOR ART
FIG. 1 shows a side view of a prior-art continuous casting installation.
Figure 3:
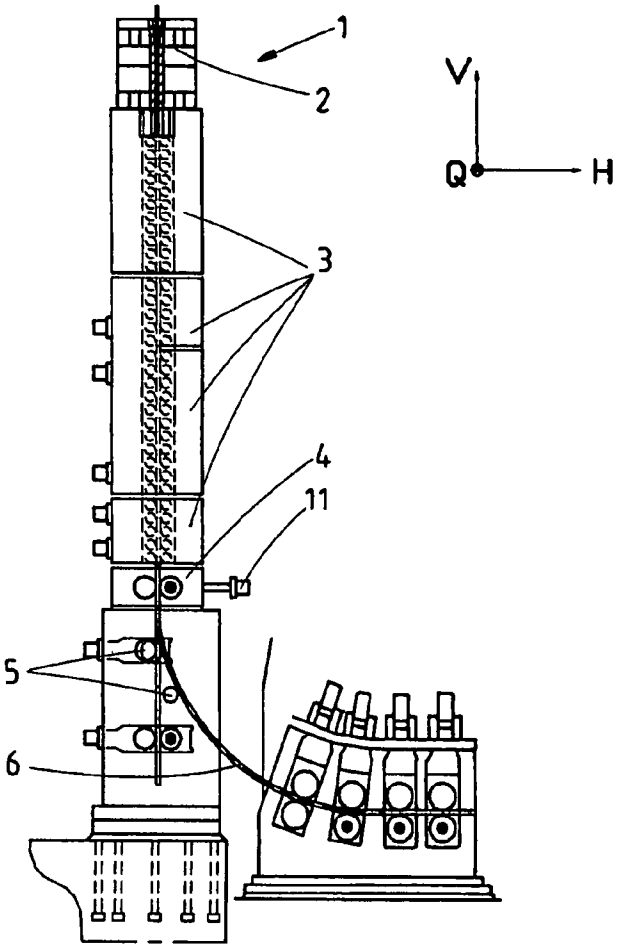
FIG. 3 shows a side view of a continuous casting installation according to the invention.
Figure 2:
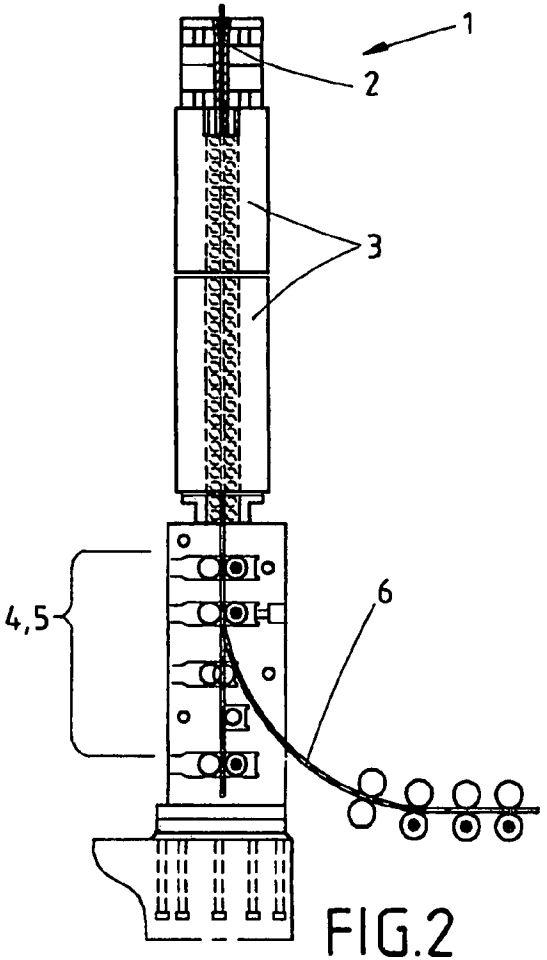
FIG.2 PRIOR ART
FIG. 2 again shows the side view according to FIG. 1.

FIGS. 2 and 3 show side by side the prior-art solution according to FIG. 1 (in FIG. 2) and an embodiment of a continuous casting installation 1 according to the invention (in FIG. 3). It is seen, first of all, that although the height of the casting installation is the same in both cases, the length of the strand guide 3 below the mold 2 is greater in the case of the new solution in accordance with the invention, which makes it possible to realize the advantages specified above. In the present embodiment, the strand guide is 1,000 mm longer. This is accomplished by virtue of the fact that means 4 that serve exclusively for driving the strand 6 are arranged directly below the strand guide 3, and means 5 that serve exclusively for bending the strand 6 are arranged below the means 4. Accordingly, in contrast to the prior-art installations, a bending driver for the combined driving and bending of the strand is no longer present.

As in the case of vertical installations, the bending radius here is in the range of 2.5 to 3.5 meters. It is thus significantly smaller than in curved mold or vertical bending installations.

Figure 4:
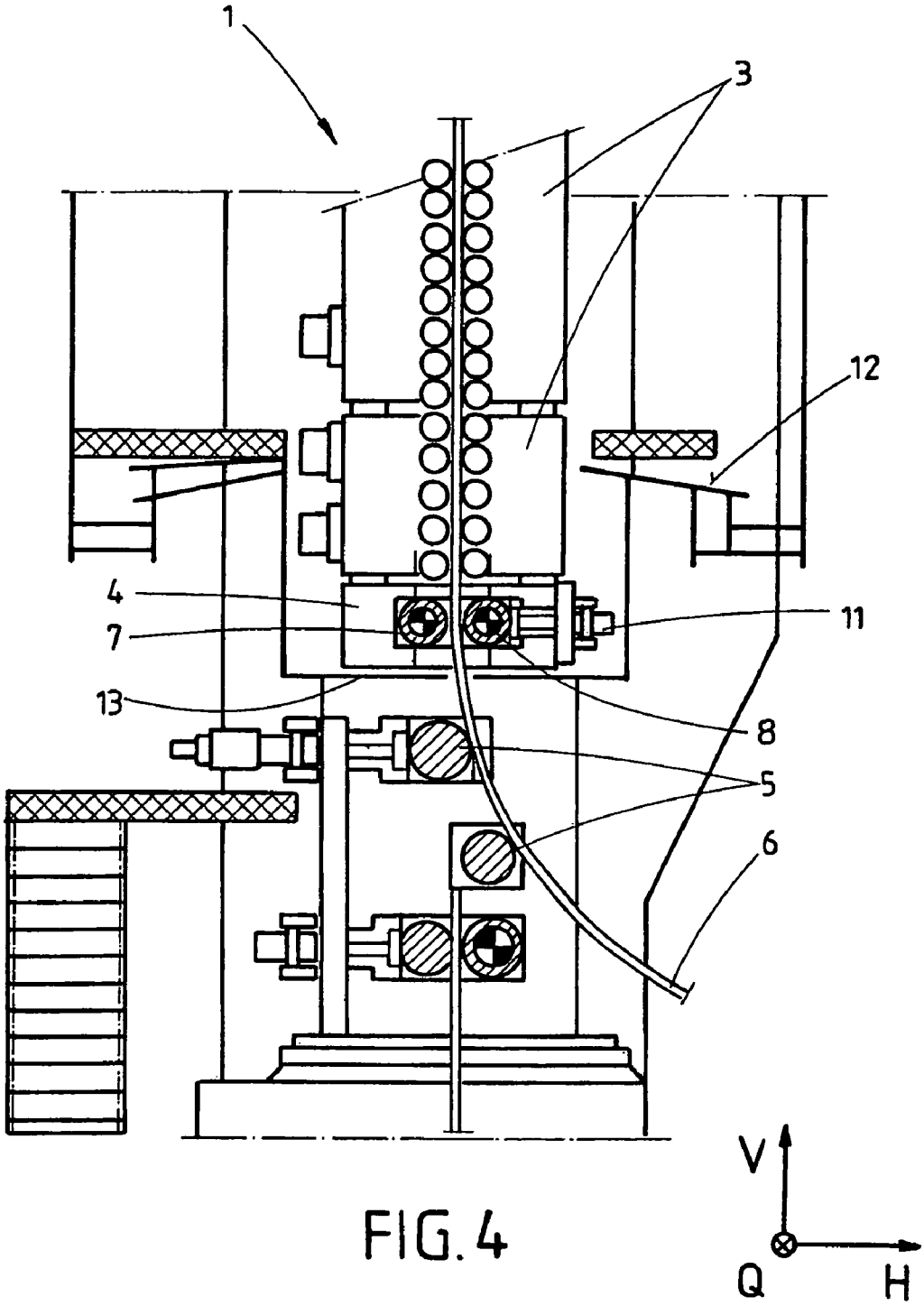
FIG. 4 shows a side view of a continuous casting installation of the invention, showing the cooling chamber.

As is apparent from FIG. 4, which shows greater detail, only a single pair of rolls 7, 8 is present in the means 4 that serve exclusively for driving the strand 6. In addition, FIG. 4 clearly shows that the cooling chamber 12 is placed in such a way here that the means 4 are arranged above the bottom 13 of the cooling chamber 12, while the means 5 are arranged below the bottom 13, i.e., outside the cooling chamber.

Figure 5:
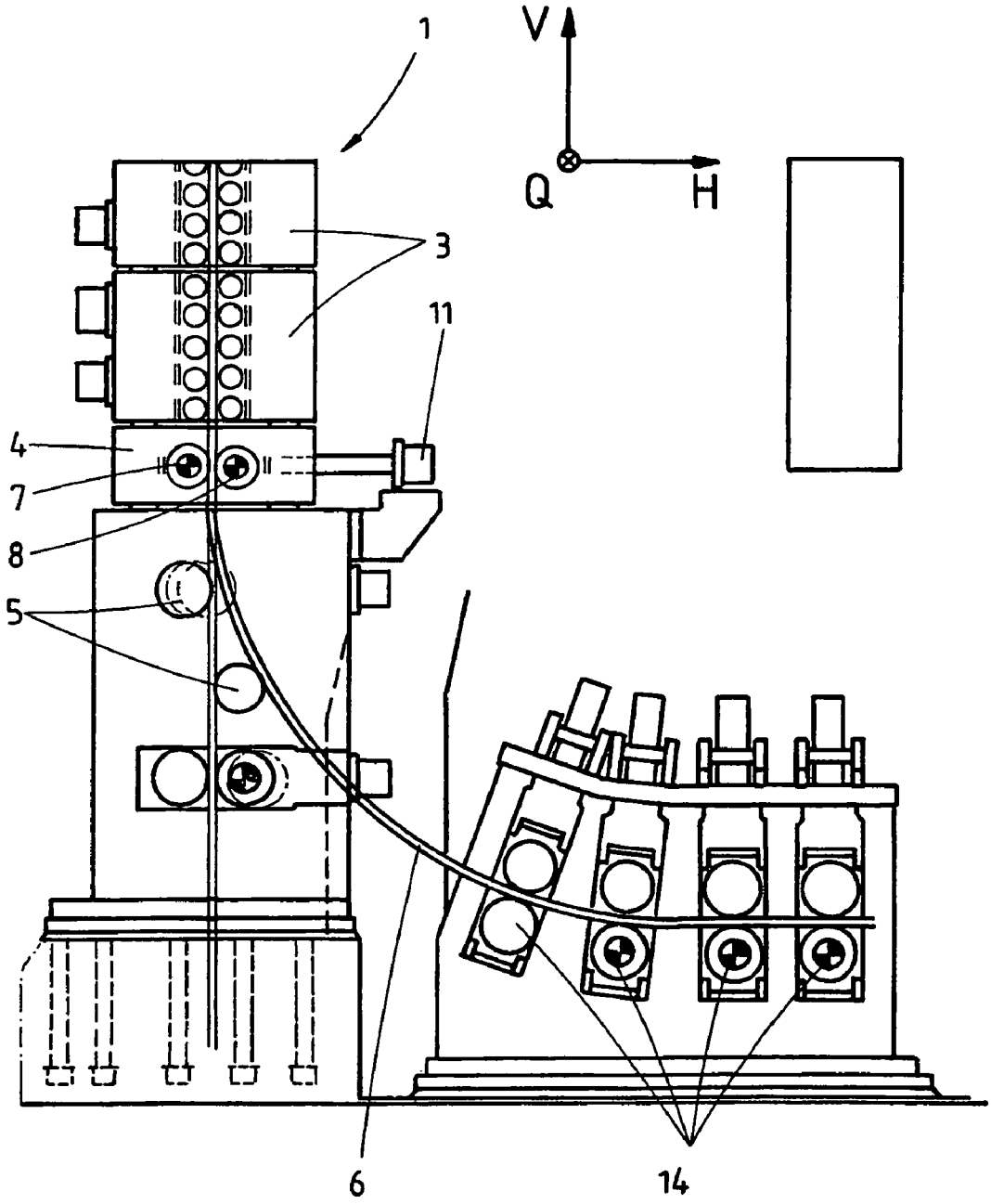
FIG. 5 shows an enlarged section of the continuous casting installation according to FIG. 3.

As FIG. 5 shows, the entire region of deflection of the strand 6 from the vertical V to the horizontal H is free of means for driving the strand. Only after the strand 6 has essentially reached the horizontal H, are driving and rolling stands 14 present. This means that the strand 6 is driven out of the strand guide 3, which itself contains no driven rolls, only by the means 4 and that there are no further drivers until the strand 6 has been deflected into the horizontal H.

Figure 6:
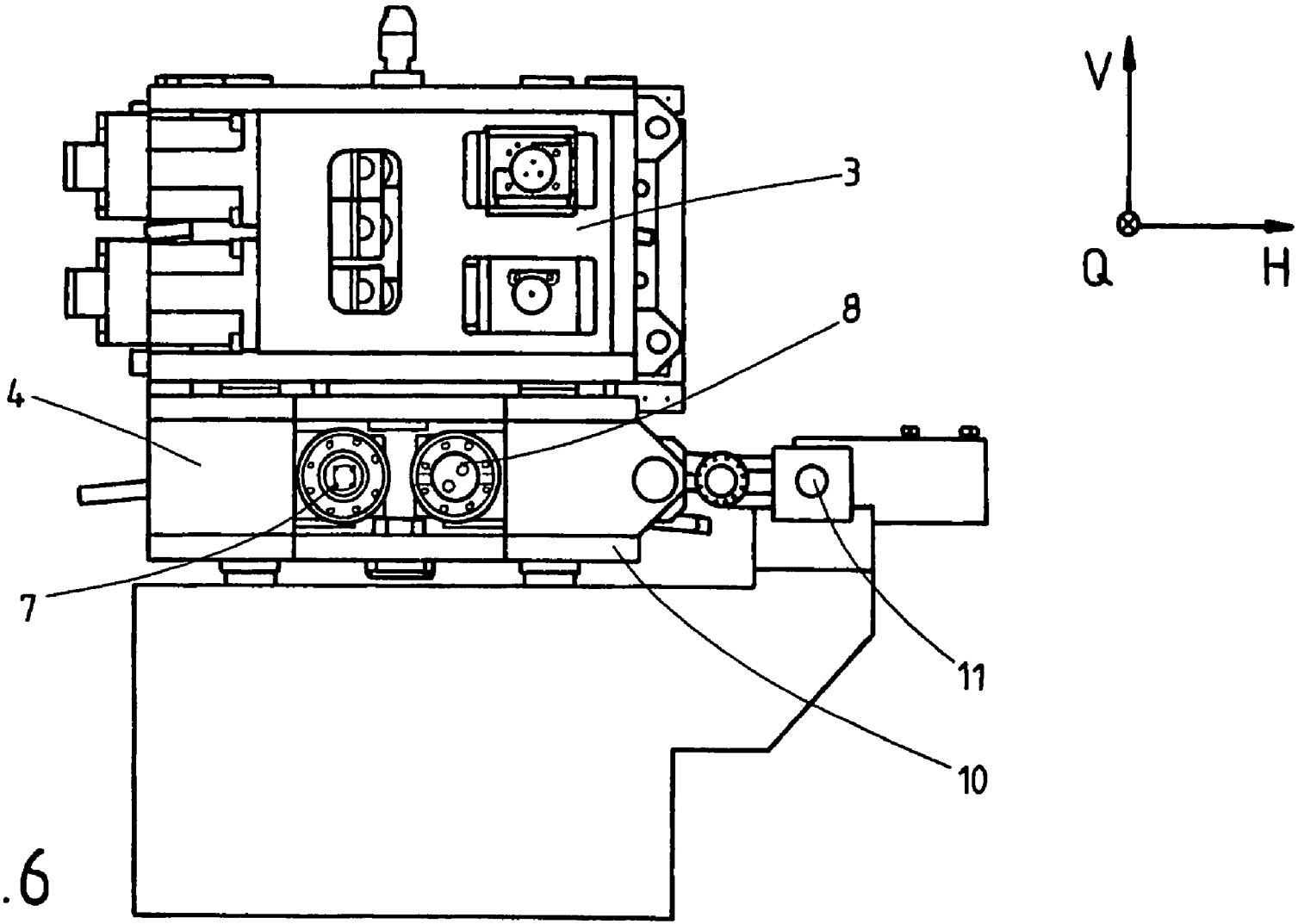
FIG. 6 shows an enlarged view of the lower end of the strand guide of the continuous casting installation, followed by the means that serve exclusively for driving the strand.
Figure 7:
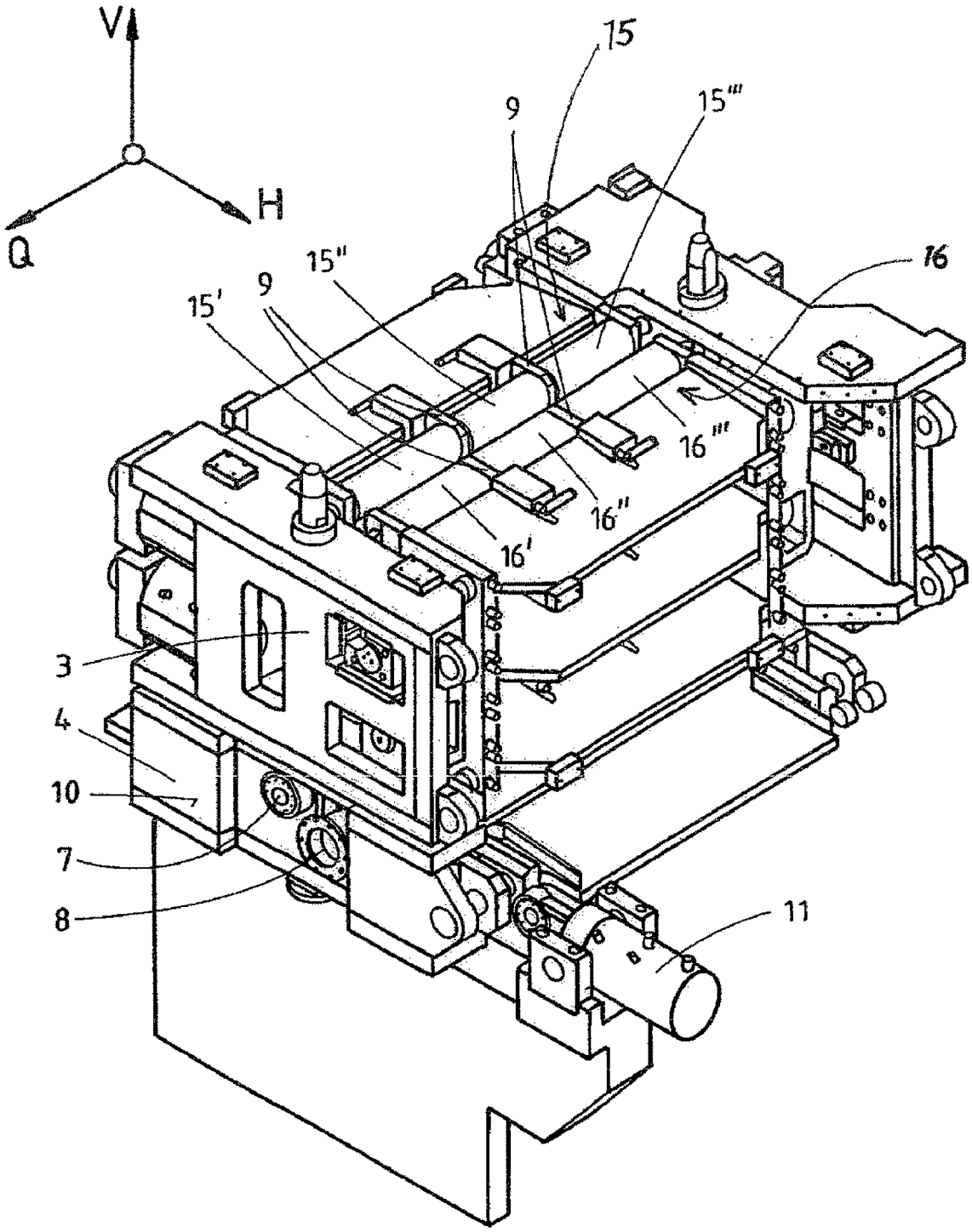
FIG. 7 shows a perspective view of the unit illustrated in FIG. 6.

FIGS. 6 and 7 show some additional details of the means 4 that serve exclusively for driving the cast strand 6. The drawings show the lowermost part of the strand guide 3 with the means 4 that serve exclusively for driving the strand 6 located directly below it. The rolls 7, 8 of the means 4, i.e., the rolls of the single pair of rolls in the means 4, are only indicated in the drawings.

These rolls 7, 8 have essentially the same design as the rolls 15, 16 of the strand guide 3 that are to be seen above them. Specifically, the rolls of the strand guide 3 consist of several roll segments 15', 15", 15'" and 16', 16", 16'" arranged in succession in the direction Q transverse to the strand 6. The rolls are supported by central bearings 9. This makes it possible to select a smaller roll diameter without having to accept any disadvantages with respect to sagging of the rolls. While rolls with a diameter of about 300 to 420 mm are generally used, this measure makes it possible to use rolls with a diameter of less than 300 mm. The higher (bending) forces in the rolls due to the smaller separations are absorbed with no problem by the central bearings 9.

The rolls 7, 8 of the means 4 are housed in a cassette 10. This cassette can be installed and removed as a whole. The position of the rolls 7, 8 is adjusted by a displacement device 11. The drawing shows only one such device in the form of a piston-cylinder system.

The proposed embodiment makes it possible to realize a significant increase in the productivity of the continuous casting installation. Furthermore, it allows faster adjustment of the installation to other production conditions and faster installation and removal of components of the installation.

The aforementioned lengthening of the strand guide by 1,000 mm made it possible to operate at a higher casting speed; in one embodiment, a casting speed of up to 6 m/min was realized. In this example, the strand had a thickness of 52 to 62 mm. It was thus possible to increase the productivity by more than 10%. The aforementioned vertical changing possibility by the oscillating frame proved to be especially advantageous.

LIST OF REFERENCE SYMBOLS

1 continuous casting installation
2 mold
3 strand guide
4, 5 means for driving and bending
4 means exclusively for driving
5 means exclusively for bending
6 cast strand
7, 8 pair of rolls
7 roll
8 roll
9 central bearing
10 cassette
11 displacement device
12 cooling chamber
13 bottom of the cooling chamber
14 rolling/driving stands
15', 15", 15'" strand guide roll
16', 16", 16'" strand guide roll
H horizontal
V vertical
Q direction transverse to the direction of conveyance of the strand
N direction normal to the surface of the strand

The invention claimed is:

1. A continuous casting installation (1), which has a vertically oriented strand guide (3) arranged below a mold (2), wherein means (4, 5) for driving a cast strand (6) and bending it into the horizontal direction (H) are arranged below the strand guide (3), and where means (4) that serve exclusively for driving the cast strand (6) are installed below the lower end of the strand guide (3), and means (5) that serve exclusively for bending the cast strand (6) are installed below the means (4) for driving the cast strand (6), wherein the means (4) that serve exclusively for driving the cast strand (6) are installed at least partially in a cassette (10), which is detachably mounted in the continuous casting installation (1), wherein the cassette is arranged beneath the vertical strand guide and above the bending means, where the continuous casting installation (1) also has a cooling chamber (12), and the cassette (10) with the means (4) that serve exclusively for driving the cast strand (6) is installed in the cooling chamber (12), the cassette being removable from and insertable into the cooling chamber as a whole together with the means for exclusively driving the cast strand.

2. A continuous casting installation in accordance with claim 1, wherein the means (4) that serve exclusively for driving the cast strand (6) have at least one pair of rolls (7, 8), which consist of several roll segments, which are arranged in succession in the direction (Q) transverse to the direction of conveyance of the strand (6) and are supported by central bearings (9).

3. A continuous casting installation in accordance with claim 1, wherein the means (4) that serve exclusively for driving the cast strand (6) comprise a single pair of driven rolls.

4. A continuous casting installation in accordance with claim 1, wherein the means (4) that serve exclusively for driving the cast strand (6) are mounted on a segmented frame located above the means (4).

5. A continuous casting installation in accordance with claim 1, wherein the one or more pairs of rolls (7, 8) are completely housed in the cassette (10).

6. A continuous casting installation in accordance with claim 1, wherein at least one roll (7, 8) of the pair of rolls is moved by a displacement device (11) in the direction (N) normal to the surface of the strand (6).

7. A continuous casting installation in accordance with claim 1, wherein the rolls (7, 8) of the means (4) for driving the strand (6) are acted upon by force in the direction (N) normal to the surface of the strand (6) by force generation elements.

8. A continuous casting installation in accordance with claim 7, wherein the force generation elements are supported on the framework of the continuous casting installation or on a structural member that is rigidly joined with the framework.

9. A continuous casting installation in accordance with claim 7, wherein the force generation elements are supported on the cassette (10).

10. A continuous casting installation in accordance with claim 1, wherein the bottom (13) of the cooling chamber (12) runs below the means (4) that serve exclusively for driving the cast strand (6) and above the means (5) that serve exclusively for bending the cast strand (6).

11. A method for operating a continuous casting installation (1), where the continuous casting installation (1) has a vertically oriented strand guide (3) arranged below a mold (2), where means (4, 5) for driving a cast strand (6) and bending it into the horizontal direction (H) are arranged below the strand guide (3), the method comprising the steps of: initially guiding the cast strand (6) vertically downward through the strand guide (3); then, below the lower end of the strand guide (3), conveying the strand (6) downward by means (4) that serve exclusively for driving the strand (6), the driving means being arranged in a cassette; and deflecting the strand (6) from the vertical (V) to the horizontal (H) by means (5) that serve exclusively for bending the strand (6); arranging the cassette beneath the vertical strand guide and above the bending means so that the cassette is removable from and insertable into a cooling chamber as a whole together with the means for exclusively driving the cast strand; and, in the region below the strand guide (3) until the discharge of the strand (6) in the horizontal direction (H), cooling the strand (6) only in the region of the means (4) that serve exclusively for driving the strand (6).

12. A method in accordance with claim 11, wherein there is no active conveyance of the strand (6) in the bending zone, in which the strand (6) is deflected from the vertical (V) to the horizontal (H).

* * * * *